US005782458A

United States Patent [19]

Prinzi et al.

[11] Patent Number: 5,782,458

[45] Date of Patent: Jul. 21, 1998

[54] CARPET STRETCHER WITH UNIVERSAL BASE

[75] Inventors: Steven J. Prinzi, Bridgeton; Paul L. Holmes, Florissant, both of Mo.

[73] Assignee: Target Sales & Marketing, Inc., Bridgeton, Mo.

[21] Appl. No.: 802,124

[22] Filed: Feb. 19, 1997

[51] Int. Cl.[6] ..... B66D 1/00

[52] U.S. Cl. ..... 254/209; 254/212

[58] Field of Search ..... 254/209, 210, 254/211, 212, 201, 204, 205, 206, 207

[56] References Cited

U.S. PATENT DOCUMENTS

| | | | |
|---|---|---|---|
| 870,671 | 11/1907 | Freed | 254/211 |
| 876,817 | 1/1908 | Logan | 254/209 |
| 943,199 | 12/1909 | Noll | 254/209 |
| 3,752,440 | 8/1973 | Ream | 254/209 |
| 3,980,274 | 9/1976 | Ebert | 254/57 |
| 5,150,884 | 9/1992 | Hyer et al. | 254/209 |
| 5,183,238 | 2/1993 | Sorenson | 254/209 |

*Primary Examiner*—Katherine Matecki
*Attorney, Agent, or Firm*—Grace J. Fishel

[57] ABSTRACT

A portable carpet stretching device enabling a user to stretch carpeting at an angle into engagement with a tack strip affixed along the base of an adjacent wall, thus to eliminate wrinkles. The device has a carpet-engaging head member and a relatively fixed base member. The front of the base member is attached by an extensible member to the rear of the head member, and pivotally connected anchoring means are utilized for securing the base member in a desired relationship to the adjacent wall. Power applying means enable the user to force the head member and the base member apart, so the anchoring of the base member with respect to the adjacent wall by the anchoring means results at the time of application of the power means, in the portion of the carpet engaged by the head member being forced toward the adjacent wall and into contact with the tack strip. The anchoring means includes a pulling plate having a lower edge adapted to engage the tack strip. The upper edge of the pulling plate is pivotally connected with a pair of elongate arms to the base member. Elongate arms are pivotally connected to the base member by a strap which is pivotally mounted on a shaft depending from a collar member. Collar member preferably has two holes for selective pinning of the base in the collar member. A pressure plate is also threaded on the shaft for use in holding the device down when the power means are being released.

16 Claims, 2 Drawing Sheets

CARPET STRETCHER WITH UNIVERSAL BASE

BACKGROUND OF THE INVENTION

1. Field of the Invention

The present invention relates to a carpet stretcher with a universal base that can be used, without modification, with various power stretchers.

2. Brief Description of the Prior Art

A power stretcher includes a head with downwardly extending teeth, a tailpiece with extensions through which pressure is applied to the opposite wall of a room and a manually operable power means interconnecting the head and the tailpiece to force the head away from the tailpiece. U.S. Pat. No. 5,150,884 to Hyer et. al. describes a portable carpet stretching device that makes use of the head and tailpiece from a power stretcher. A pair of elongate arms pivotally connect a pulling plate that engages a tack strip with a pivotally mounted member on a short collar member. The tail piece is received and pinned in the collar member, making use of the holes, typically spaced two inches apart, provided in the tailpiece for adjusting the length of the stretcher braced against an opposing wall. The pivotally mounted member is located on the top side of the tailpiece, opposite the downwardly extending teeth, facing a user.

While the Hyer et al. portable carpet stretching device is a great improvement over the prior art, it has some short comings. The distance between the head and the tailpiece differs in power stretchers from different manufacturers. It is important that the front of the head member be no more than about three inches from the tack strip to prevent the formation of a bubble in the carpet. In the Hyer et al. device, the elongate arms must be provided in different lengths for different brand power stretchers because the device is only adjustable in two-inch intervals. In use, the Hyer et al. portable carpet stretching device generates an effective stretching force when the handle on the power means is pressed in the direction of the pivotally mounted member, closing a toggle joint, but in the process sometimes mashing the user's fingers between the handle and the pivotally mounted member on the tail piece. When the handle is pulled to release the stretching force as shown in FIG. 4, instead of opening the toggle joint, the device tends to rear up, there being no convenient way to hold the tailpiece down. As the tail piece is lifted, the pulling plate puts increased pressure on the tack strip, making the toggle joint more difficult to open.

SUMMARY OF THE INVENTION

In view of the above, it is an object of the present invention to provide a portable carpet stretching device with a toggle joint that can be opened without lifting the tail piece. It is another object to provide a portable carpet stretching device with a universal base that can be used with carpet-engaging head members from different power stretchers. Other objects and features of the invention will be in part apparent and in part pointed out hereinafter.

In accordance with the invention, a portable carpet stretching device for enabling a user to stretch carpeting at an angle into engagement with a tack strip affixed along the base of an adjacent wall has a carpet-engaging head member and a base member, each of which has front and rear portions. The front of the base member is attached by an extensible member to the rear of the head member, with the head member being closer to the adjacent wall than the base member. The base member has a tail piece with a plurality of spaced apart holes and a collar member with at least one hole, and preferably two. The tail piece is received into the collar member and selectively pinned with a pin member. A shaft is attached to the collar member opposite the extensible member. A pressure plate and a strap are pivotally mounted on the shaft with the strap sandwiched between the pressure plate and the collar member. The extensible member can be extended without mashing a user's fingers on the strap and contracted without lifting the tail piece if the user places some weight on the pressure plate. When collar member has at least two spaced apart holes, the portable carpet stretching device has a universal base allowing the operator to adjustably space the front of the head member within about three inches of the tack strip irrespective of the brand head member.

Anchoring means are provided for securing the base member with its front portion in a fixed relationship to the adjacent wall, along with power applying means for causing the head member and the base member to be forced apart. The anchoring of the base member with respect to the adjacent wall by the anchoring means occurs at the time the power means is employed, simultaneously forcing a portion of the carpet engaged by the head member toward the adjacent wall and into contact with the tack strip. The anchoring means comprises a pulling plate having elongate upper and lower edges, with the lower edge including means for engaging the tack strip located along the base of the adjacent wall and with the upper edge being pivotally connected to the strap by a pair of elongate arms. The elongate arms, in the manner of the Hyer et al. device, enable the head member to be moved into a non-symmetrical relationship to the pulling plate, whereby a pull at an angle to the adjacent wall can be applied by the head member to the carpet when the power applying means is operated.

The invention summarized above comprises the constructions hereinafter described, the scope of the invention being indicated by the subjoined claims.

BRIEF DESCRIPTION OF THE DRAWINGS

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
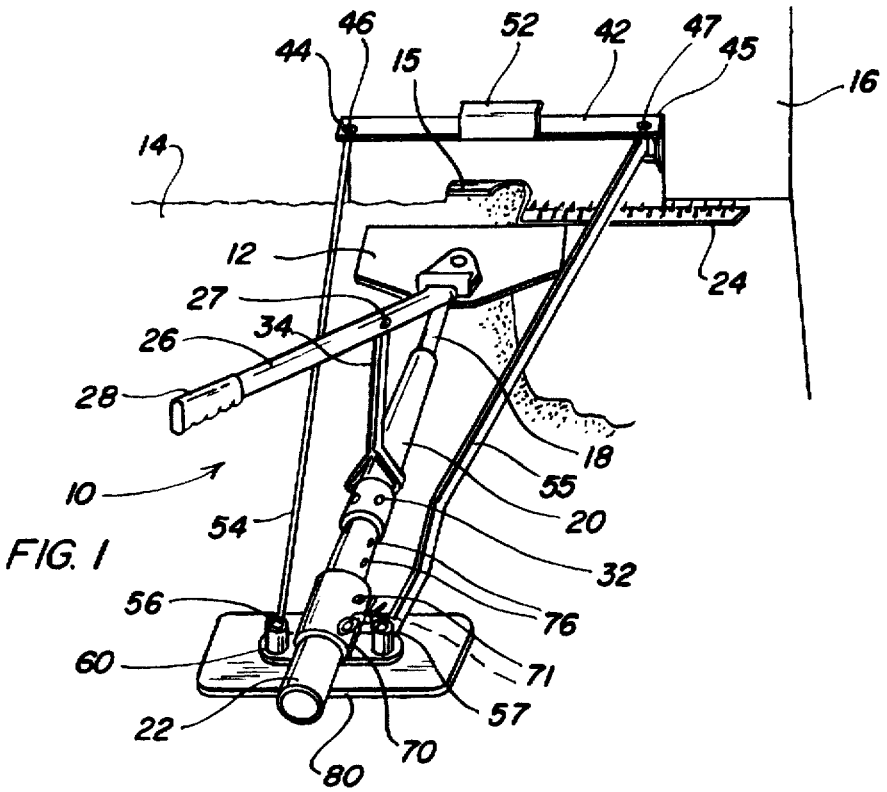
FIG. 1 is a perspective view of a preferred embodiment of a carpet stretching device in accordance with the present invention, shown in relation to a tack strip laid along the base of a near wall, with a pulling plate utilized to engage the tack strip, said pulling plate being pivotally mounted to a strap with a pair of elongate arms.
Figure 2:
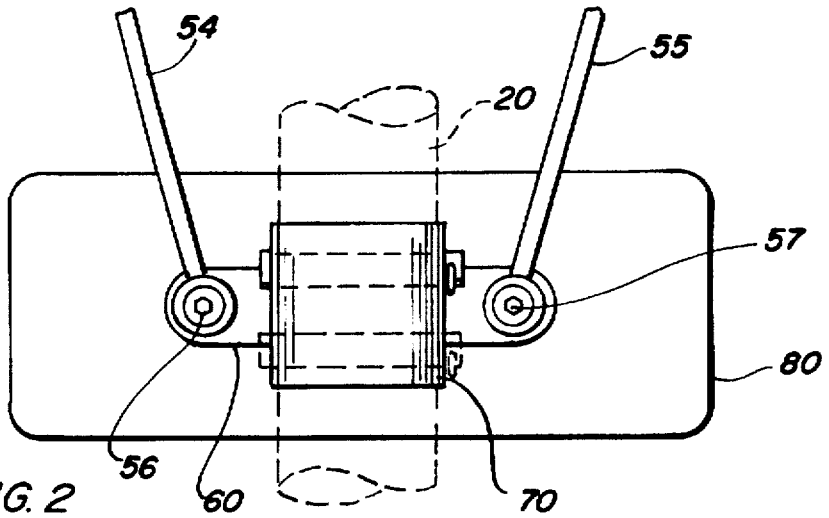
FIG. 2 is a detail, in plan, of a collar member from which is pendently and pivotally mounted the strap and a pressure plate, with the opposite end of elongate arms pivotally mounted to the strap.
Figure 3:
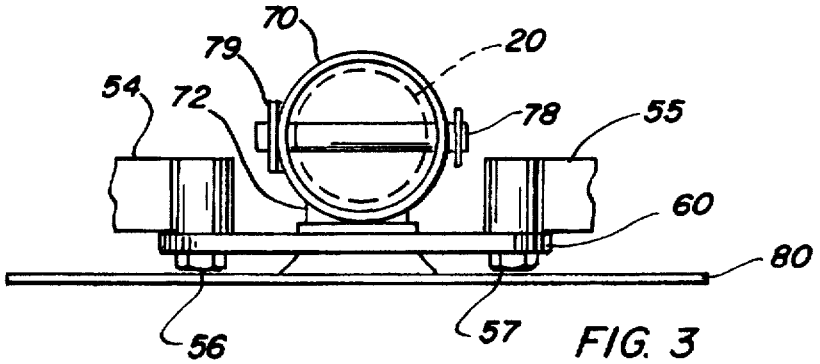
FIG. 3 is a detail, in side elevation, of the collar member, strap and pressure plate shown in FIG. 2.

Referring to the drawings more particularly by reference character, reference numeral 10 refers to a carpet stretching device in accordance with the present invention, including a head member 12 with a toothed undersurface adapted to engage a carpet 14 to be stretched toward a near wall 16.

The rearmost end of head member 12 is attached to the forwardmost portion of a tubular member 18, which slidably engages a relatively fixed tubular member 20, the latter also being known as the base member. The base member or tubular member is typically of a larger diameter than that of tubular member 18, and because of the slidable relationship of these two tubularly shaped members, the distance between head member 12 and the relatively fixed tubular member 20 can be readily changed during the installation of a carpet, as will be explained shortly.

In accordance with the power stretchers of the prior art, one end of at least one fixed length extension tube or pole (not shown) is inserted into tail piece 22 of relatively fixed tubular member 20, with the far end of such extension tube being arranged to derive a fixed relationship on behalf of the tubular member 20, by the direct or indirect contact of the end of the extension tube with a far wall of a room in which carpet 14 is being installed.

It is frequently necessary, when using the power stretchers of the prior art to utilize a plurality of fixed length, interfitting tubes in order that tubular member 20 can attain a momentary fixed relationship to near wall 16 of the room, toward which an edge 15 of carpet 14 is stretched. In order that this can be accomplished, an appropriate relationship of tubular member 20 to the far wall must be established in order that a handle member 26, described hereinafter, can be manipulated by a carpet installer in order to force the carpet portion engaged at that time by head member 12, toward a tack strip 24 that is located along the baseboard of near wall 16.

Handle member 26 is pivotally affixed to the rearmost end of head member 12, which handle member can be moved between raised and lowered positions, locking and unlocking a toggle joint, for a purpose soon to be explained. The end of handle member 26 remote from head member 12 is equipped with a suitable handgrip 28, and the typical motion of the handle is indicated by the double-headed arrow in FIGS. 4 and 5.

Typically attached to the upper surface of relatively fixed tubular member 20 is an attachment point 32, to which is pivotally attached a sturdy link 34 of fixed length. The end of link 34 opposite attachment point 32 is pivotally attached to a midpoint 27 on the underside of handle member 26. These components form a toggle joint familiar to most persons acquainted with the carpet installation trade.

In accordance with the power stretchers of the prior art, tubular member 20 can achieve a fixed relationship to the previously mentioned remote wall of the room, by the use of an appropriate number of interfitting tubes or poles. When this has been accomplished, the carpet installer then pushes down upon handgrip 28 of handle member 26, which causes, by the intervention of link 34, a forward motion of the front of handle member 26, which in turn forces head member 12 forward, toward near wall 16.

Because of its toothed undersurface, this motion of head member 12 in turn forces edge 15 of carpet 14 toward near wall 16, so that the edge of the carpet nearest the wall can engage the sharp points on tack strip 24 located adjacent the baseboard of wall 16. It is expected that the carpet installer will use a hammer or the like to drive the underside of carpet 14 into firm engagement with the upstanding points of the tack strip 24, after which the installer proceeds to cut away the excess portions of the carpet in a very precise manner by the use of a sharp blade.

At this particular setting of the tubular extension members used in accordance with the prior art, the carpet installer can move the carpet-engaging head member 12 to a number of adjacent locations on carpet 14. By the teeth on the underside of head member 12 engaging successive locations on the carpet, an entire area of carpet 14 can be effectively moved toward near wall 16. As is obvious, the carpet installer can move the array of interfitting tubes a bit in the appropriate lateral direction from time to time, so that the tube array will at all times be in contact with the most auspicious locations on the far wall. This will best enable the installer to continue the task of moving substantial portions of edge 15 of carpet 14 into a tight relationship with tack strip 24 extending along the base of near wall 16.

It should be briefly noted at this time that in most instances, the tube array lies essentially in a perpendicular relationship to near wall 16, but in order to reduce wrinkling, the carpet installer may from time to time utilize the power stretcher in an angled relationship to near wall 16 as described in the Hyer et al. patent.

In connection with the explanation of FIG. 1, very little that is new has been described thus far over prior art power stretchers and the Hyer et al. patent. Roberts Consolidated Industries, Inc. of 600 North Baldwin Park Blvd., City of Industry, Calif. 91749 makes a power stretcher of the type shown in FIG. 1, and no claim to inventorship is made in such a device per se. Power stretchers made by different manufacturers differ slightly in overall length and in the distance to a first hole 76 in tail piece 22. For example a Roberts' junior power stretcher has an overall length of 29 inches and a distance of 26.5 inches to the first hole, whereas a Crain junior stretcher, manufactured by Crain Cutter Company, Inc. of 156 South Milpitas Blvd., Milpitas, Calif. 95035, has an overall length of 25 inches and a distance of 22.5 inches to the first hole. Other manufactures of power stretchers include Taylor Tool/Roofing Equipment of 11075 East 47th Avenue, Denver, Colo. 80239 and Gundlach Company of 211 North 21st Street, Belleville, Ill. 62222. Certain portions of carpet stretching device 10 are new, however, as are about to be explained.

In FIG. 1, carpet stretching device 10 in accordance with the present invention includes, in combination, a power carpet stretcher and an attachment device. The power carpet stretcher includes a head member 12, the relatively slidable member 18 that interfits with the tubularly shaped base member 20, handle member 26 and link member 34.

The attachment device portion of carpet stretching device 10 has a pivotally mounted pulling plate 42 that is designed to be placed adjacent tack strip 24 along near wall 16, and the components associated with the pulling plate. With continuing reference to FIG. 1 in combination with FIG. 5, pulling plate 42 has a handle 52, a lower edge 43 designed to engage tack strip 24, and an upper left corner 44 as well as an upper right corner 45. Elongate arms 54 and 55 are pivotally attached to upper corners 44 and 45, respectively, of pulling plate 42, and the construction and purpose of these components will be discussed shortly.

In accordance with common practice, a tack strip resembling the tack strip illustrated in FIG. 1 is found nailed around the four sides of the room. Inasmuch as it is customary to drive nails through the tack strips and into the floor at approximately six inch intervals, pulling plate 42 should be long enough to extend across at least two, and preferably three, nails associated with the tack strip. Thus, a pulling plate 42 that is approximately 18 inches wide is preferred, although not limited to this, as it spreads the load over three nails.

In addition to spreading the load over three nails as discussed above, when the distance between elongate arms 54 and 55 is greater than in the Hyer et al. patent, the carpet installer has even better visibility of the work area to deal with unsecured edge 15 of carpet 14 during the carpet installation procedure, and making it more readily possible for the carpet installer to press down upon the carpet in order to secure the underside of the carpet to the tack strip of the adjacent wall.

Figure 5:
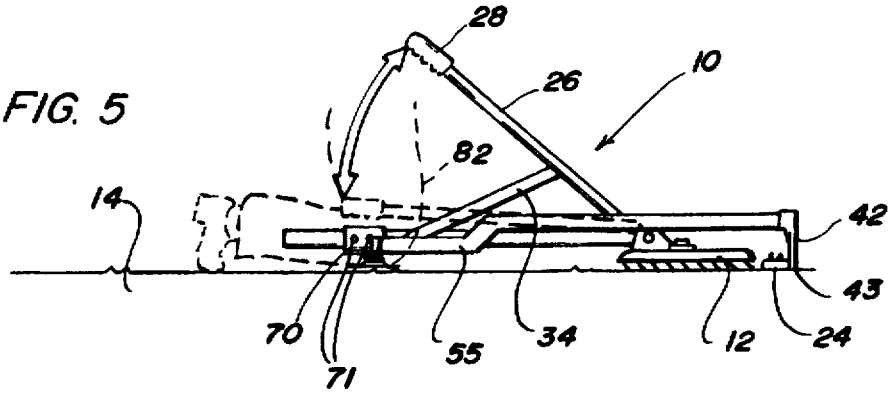
PRIOR ART FIG. 5
FIG. 5 is a somewhat simplified view illustrating how lifting is prevented with the carpet stretching device in accordance with the present invention; and, FIG. 6 is an exploded view of the collar member, strap and pressure plate shown assembled in FIGS. 2 and 3.

On the upper left and right corners 44 and 45 of pulling plate 42 are attached the front ends of the elongated arm members 54 and 55, as best seen in FIG. 1. A pivotal connection 46, preferably an allen bolt, is utilized at upper left corner 44, and a pivotal connection 47, preferably an allen bolt, is utilized at upper right corner 45 of pulling plate 42, where the front portions of arms 54 and 55, respectively, are attached to pulling plate 42. As best seen in FIG. 5, arms 54 and 55 are of a structural nature and are preferably z-shaped in plan so that a short tubular member 70, as more particularly described below, is tilted slightly forward. Arms 54 and 55 are preferably about 27 inches long and the overall length of device 10 is under 3 feet so that it can be used in hallways too, most corridors being 35 inches wide. It will be understood, however, that device 10 may be larger for use in laying carpet in ballrooms and the like.

The rear ends of arms 54 and 55 are pivotally attached at 56 and 57, preferably with allen bolts, to a short, sturdy, pivotally mounted member or strap 60, that is attached at a selected location on tail piece 22 opposite handle member 26. Strap 60 is mounted on short collar member 70 of a diameter large enough to be slid upon tail piece 22, with a tapped downward projection 72, illustrated as a nut welded or otherwise secured to the bottom of member 70, forming the direct support for member 60. At least one hole 71 is also provided in collar member 70.

Figure 6:
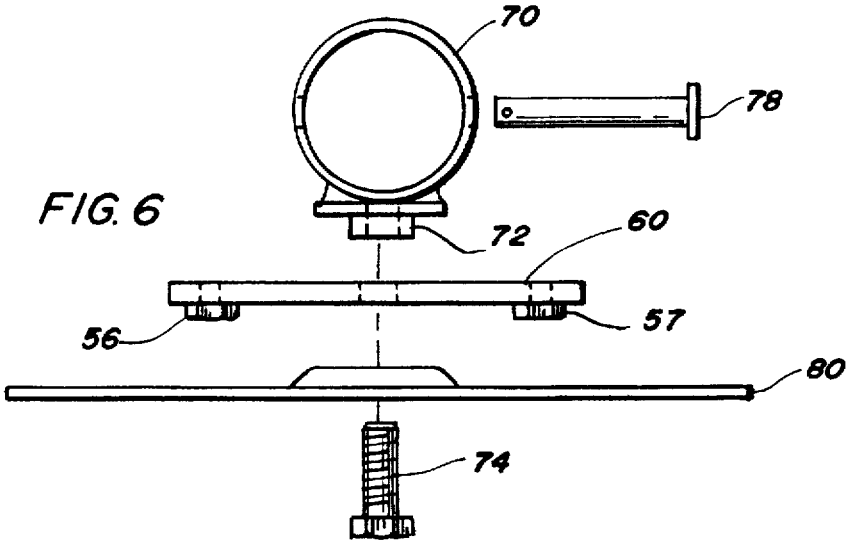

As is obvious from FIG. 6, a bolt 74 is threaded in projection 72 forming a shaft attached to collar member 70. Strap 60 is prevented from undesired displacement from its pivotal mounting on the shaft by bolt 74.

The power stretchers made by Roberts as well as other manufacturers normally have a spaced plurality of generally horizontally arrayed holes 76, usually spaced about two inches apart, located in tail piece 22, such holes being indicated in FIG. 1. By the use of a pin 78 or the like, that is inserted through hole 71 and a selected hole 76 and secured with a cotter key 79, the carpet installer can readily secure the short collar member 70 to an appropriate location on tail piece 22, in that way to achieve a carpet installing device of unitary construction. When short collar member 70 is provisioned with at least two holes, preferably spaced apart one inch apart, the base member is made universal for use with head members by different manufacturers so as to position the front of the head member within three inches of the tack strip.

A pressure plate 80 is also pivotally mounted on bolt 74, with strap 60 sandwiched between the collar member and the pressure plate. Pressure plate 80 is sufficiently long that the user can rest his knee 82 as shown in FIG. 5 on one end of the plate.

By virtue of the pivotal connections on both ends of arms 54 and 55, the relationship of head member 12 with respect to pulling plate 42 can, in a highly advantageous manner, be readily changed during a carpet installation procedure, and even more important, tail piece 22 can be easily swung away from a centerline 30 shown in U.S. Pat. No. 5,150,884 at such time as wrinkles develop in the carpet during the installation procedure. In this way, as described in the Hyer et al. patent, which description is incorporated by reference herein, the carpet installer can easily bring about the highly desirable angular pulls that will greatly simplify the task of eliminating wrinkles in the carpet during the procedure of bringing the edges of the carpet into proper contact with the respective tack strips.

Figure 4:
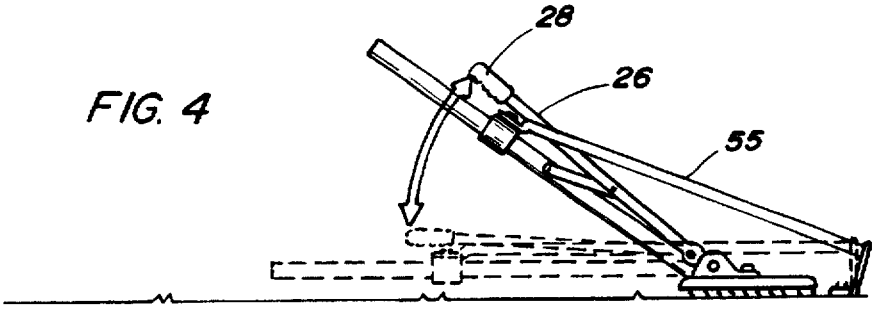
FIG. 4 is a somewhat simplified view illustrating the use of the Hyer et al. carpet stretching device's tendency to rear up when a handle on the extensible member is lifted.

In use, when the extensible member is extended, the user's fingers are not mashed between handle member 26 and strap 60 as in the Hyer et al. carpet stretcher. In addition, device 10 can be prevented from lifting off the floor as shown in FIG. 4 if the user applies weight (e.g., his knee 82) to pressure plate 80 as shown in FIG. 5. These features, along with those mentioned above, set the present portable carpet stretching device apart from the prior art.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A portable carpet stretching device for enabling a user to stretch carpeting at an angle into engagement with a tack strip affixed along the base of an adjacent wall, said device comprising a carpet-engaging head member and a base member, each of said members having front and rear portions, with the front of said base member being attached by an extensible member to the rear of said head member, and with said head member being closer to the adjacent wall than the base member, said base member being connected to a tail piece with a plurality of spaced apart holes upon which is mounted a collar member with at least one hole, said tail piece being received into the collar member and selectively pinned with a pin member, a shaft attached to the collar member, a pressure plate and a strap pivotally mounted on the shaft with the strap between the pressure plate and the collar member, said pressure plate having a length greater than the strap, whereby the extensible member can be extended without mashing a user's fingers on the strap and the extensible member can be contracted without lifting the device by placing a weight on a portion of the pressure plate that extends past the strap, anchoring means for securing said base member with its front portion in a fixed relationship to the adjacent wall, power applying means for causing said head member and said base member to be forced apart, the anchoring of said base member with respect to the adjacent wall by said anchoring means resulting at the time of application of the power means, in the forcing of a portion of the carpet engaged by said head member toward the adjacent wall and into contact with the tack strip, said anchoring means comprising a pulling plate having elongate upper and lower edges, with the lower edge of said pulling plate including means for engaging the tack strip located along the base of the adjacent wall, and with the upper edge of said pulling plate being pivotally connected to said strap by a pair of elongate arms, said elongate arms enabling said head member to be moved into a non-symmetrical relationship to said pulling plate, whereby a pull at an angle to the adjacent wall can be applied by said head member to the carpet when said power applying means is operated.

2. The portable carpet stretching device for enabling a user to stretch carpeting at an angle as defined in claim 1 wherein the collar member has at least two spaced apart holes, whereby different head members can be used with the same universal base by selecting different holes in the tail piece and the collar member.

3. The portable carpet stretching device for enabling a user to stretch carpeting at an angle as defined in claim 2 wherein the elongate arms are generally z-shaped in plan so that the collar member is tilted slightly forward.

4. The portable carpet stretching device for enabling a user to stretch carpeting at an angle as defined in claim 3 wherein said pulling plate is wide enough to substantially span three nails in the tack strip set at 6-inch intervals.

5. The portable carpet stretching device for enabling a user to stretch carpeting at an angle as defined in claim 4 wherein the elongate arms are pivotally connected to the pulling plate and the strap with allen bolts.

6. A portable carpet stretching device for enabling a user to stretch carpeting at an angle into engagement with a tack strip affixed along the base of an adjacent wall, said device comprising a carpet-engaging head member and a base member, each of said members having front and rear portions, with the front of said base member being attached by an extensible member to the rear of said head member, such that in a use portion, said head member is closer to the adjacent wall than said base member, said base member being connected to a tail piece with a plurality of spaced apart holes upon which is mounted a collar member with at least two spaced apart holes into which said tail piece is received and selectively pinned with a pin member, a shaft attached to the collar member, a pressure plate and a strap pivotally mounted on the shaft with the strap between the pressure plate and the collar member, said pressure plate having a length greater than the strap, whereby different head members can be used with the same universal base member by selecting the holes in the tail piece and the collar member and whereby the extensible member can be extended without mashing a user's fingers on the strap and the extensible member can be contracted without lifting the device by placing a weight on a portion of the pressure plate that extends past the strap, anchoring means for securing said base member with its front portion in a fixed relationship to the adjacent wall, power applying means for causing said head member and said base member to be forced apart, the anchoring of said base member with respect to the adjacent wall by said anchoring means resulting in a portion of the carpet engaged by said head member being forced toward the adjacent wall and into contact with the tack strip when said head member and said base member are forced apart by said power applying means, said anchoring means comprising a pulling plate having elongate upper and lower edges, with lower edge of said pulling plate including means for engaging the tack strip located along the base of the adjacent wall, a pair of elongate arms connecting the upper edge of said pulling plate to said base member, with one end of each of said arms being pivotally connected adjacent one upper corner of said pulling plate and the other end of each arm being pivotally connected to opposite ends of the strap, this pivotal connecting of said arms enabling said head member to be moved into a non-symmetrical relationship to said pulling plate, whereby a pull at an angle to the adjacent wall can be applied to the carpet by said head member when said power applying means is utilized.

7. The portable carpet stretching device for enabling a user to stretch carpeting at an angle as defined in claim 6 wherein the elongate arms are generally z-shaped in plan so that the collar member is tilted slightly forward.

8. The portable carpet stretching device for enabling a user to stretch carpeting at an angle as defined in claim 7 wherein said pulling plate is wide enough to substantially span three nails in the tack strip set at 6-inch intervals.

9. The portable carpet stretching device for enabling a user to stretch carpeting at an angle as defined in claim 8 wherein the elongate arms are pivotally connected to the pulling plate and the strap with allen bolts.

10. The portable carpet stretching device for enabling a user to stretch carpeting at an angle as defined in claim 9 wherein the holes in the tail piece are at about two inch intervals and the holes in the collar member are about one inch apart.

11. An attachment device for a power carpet stretcher for enabling a user to stretch carpeting at an angle into engagement with a tack strip affixed along the base of an adjacent wall, the power carpet stretcher having a carpet-engaging head member and a base member, each said members having front and rear portions, with the front of the base member being attached by an extensible member to the rear of the head member, and with the head member being closer to the adjacent wall than the base member, the base member being connected to a tail piece with a plurality of spaced apart holes, and a power applying means for causing the head member and the base member to be forced apart, said attachment device comprising a collar member with at least one hole which is mounted on the tail piece of the power carpet stretcher, the collar being adapted to receive the tail piece and a pin for selectively pinning the tail piece in the collar, a shaft attached to the collar member, a pressure plate and a strap pivotally mounted on the shaft with the strap between the pressure plate and the collar member, said pressure plate having a length greater than the strap, whereby the extensible member can be extended without mashing a user's fingers on the strap and the extensible member can be contracted without lifting the device by placing a weight on a portion of the pressure plate that extends past the strap, anchoring means for securing the base member with its front portion in a fixed relationship to the adjacent wall, the anchoring of said base member with respect to the adjacent wall by said anchoring means resulting at the time of application of the power means, in the forcing of a portion of the carpet engaged by the head member toward the adjacent wall and into contact with the tack strip, the anchoring means comprising a pulling plate having elongate upper and lower edges, with the lower edge of said pulling plate including means for engaging the tack strip located along the base of the adjacent wall, and with the upper edge of said pulling plate being pivotally connected to said strap by a pair of elongate arms, said elongate arms enabling the head member to be moved into a non-symmetrical relationship to the pulling plate, whereby a pull at an angle to the adjacent wall can be applied by the head member to the carpet when the power applying means is operated.

12. The attachment device of claim 11 where the collar member has at least two spaced apart holes, said holes spaced at a shorter interval than the holes in the tail piece, whereby different power carpet stretchers can be used with the same attachment device by selecting different holes in the tail piece and the collar member.

13. The attachment device of claim 11 wherein the elongate arms are generally z-shaped in plan so that the collar member is tilted slightly forward.

14. The attachment device of claim 13 wherein the collar member is asymmetrically mounted on the shaft.

15. The attachment device of claim 11 wherein the pulling plate is wide enough to substantially span three nails in the tack strip set at 6-inch intervals.

16. The attachment device of claim 15 wherein the elongate arms are pivotally connected to the pulling plate and the strap with allen bolts.

* * * * *